US007455064B2

(12) United States Patent
Moles

(10) Patent No.: US 7,455,064 B2
(45) Date of Patent: Nov. 25, 2008

(54) REGULATOR PLUG FOR THE THERMOFORMABLE DIVE MOUTHPIECE

(75) Inventor: Randall Moles, Racine, WI (US)

(73) Assignee: SeaCure, Inc., Racine, WI (US)

( * ) Notice: Subject to any disclaimer, the term of this patent is extended or adjusted under 35 U.S.C. 154(b) by 506 days.

(21) Appl. No.: 11/189,471

(22) Filed: Jul. 26, 2005

(65) Prior Publication Data

US 2007/0023054 A1 Feb. 1, 2007

(51) Int. Cl.
*A61M 11/00* (2006.01)

(52) U.S. Cl. ..... 128/861; 128/201.26

(58) Field of Classification Search ..... 128/859–862, 128/201.26, 201.25, 206.29
See application file for complete search history.

(56) References Cited

U.S. PATENT DOCUMENTS 4,944,947 A * 7/1990 Newman ..... 424/435
5,031,611 A 7/1991 Moles
5,074,375 A * 12/1991 Grozil ..... 181/135
5,253,658 A * 10/1993 King ..... 128/859
5,305,741 A 4/1994 Moles
5,732,715 A * 3/1998 Jacobs et al. ..... 128/861
5,865,170 A 2/1999 Moles
6,109,266 A 8/2000 Turchetti

OTHER PUBLICATIONS

JAX: Instructions—http://www.myjaxdive.com/english/instructions, Nov. 3, 2005.
JAX Photo—http://www.divernet.com/bubbling/pics/0104bubbling05.jpg, Nov. 3, 2005.

* cited by examiner

*Primary Examiner*—Steven O Douglas
(74) *Attorney, Agent, or Firm*—Jansson Shupe & Munger Ltd

(57) ABSTRACT

The invention involves a plug for a dive mouthpiece. The plug comprises a plug portion and a handle portion. The plug portion has a plug-portion distal end and a plug-portion proximal end. The plug-portion includes an exterior surface, which is complementary in shape to a distal portion of the passageway shape of the mouthpiece. The handle portion has a handle-portion proximal end integral with the plug-portion distal end. The handle portion also has a handle-portion distal end and of a handle-portion exterior surface configured to be complementary in shape to the proximal portion of the passageway shape of the mouthpiece.

29 Claims, 4 Drawing Sheets

REGULATOR PLUG FOR THE THERMOFORMABLE DIVE MOUTHPIECE

FIELD OF THE INVENTION

This invention is related generally to dive mouthpieces and, more particularly, to thermoformable dive mouthpieces.

BACKGROUND OF THE INVENTION

A major improvement to the regulator mouthpiece art was the provision of a custom-moldable, thermoformable dive mouthpiece embodied in U.S. Pat. Nos. 5,305,741 and 5,865,170 issued to Moles (which are incorporated herein in their entirety by reference). The thermoformability allowed for the customization by the ultimate user.

Thermoformability, however, causes deformation during the heating process of all thermoformable components, including the air passageway to the diver from the regulator. One first attempt to protect the passageway shape integrity during the customization process was taken in the dive mouthpiece product offered by SeaCURE, Inc., which provides a harder plastic band inserted into the passageway which band would not deform during the thermoforming process. In this manner, the passageway would be constrained to maintain its shape by the band. Fabrication of such a mouthpiece requiring components of two different deformation temperatures is more expensive than the fabrication of a similar mouthpiece made of only one constituent material.

Furthermore, during the thermoforming process of customodable dive mouthpieces such as that described in the Moles devices which are the subject of the patents referenced above, the tooth engaging legs of the mouthpiece must be immersed in boiling water. As there is no handle portion, current thermoforming process requires the use of a tool such as tongs to grab the heated, pliable mouthpiece from the boiling water. In grabbing the mouthpiece with the tongs, the tong must engage either the leg portions or the regulator passageway portion, either of which allow for the possibility of unintended and disadvantageous deformation of the thermoformable plastic by the tong pressure.

Further, when any regulator, whether thermoformable or otherwise, is not in use, it must be stored. Typically, such mouthpieces are stored on the regulator. During the storage period, the in-mouth portion of the passageway to the regulator is exposed. During the storage period, dust, microorganisms, and environmental pollutants may enter this passageway. Moreover, during storage, it has frequently been observed that small insects and other animals frequent the enclosed concavity of the in-mouth portion of the passageway.

A removable plug which would maintain the profile of the passageway during the thermoforming process would be an important improvement in the art. Moreover, a plug which would provide a handle would be an improvement on the prior art. Further still, a plug which would releasably seal the in-mouth end of a regulator passageway during the storage period would be an important improvement of the art.

OBJECTS OF THE INVENTION

It is an object of the invention to provide a passageway-shape maintaining device for thermoformable dive mouthpieces overcoming some of the problems and shortcomings of the prior art, including those referred to above.

Another object of the invention is to provide a shape-maintaining plug that maintains the regulator portion of a dive mouthpiece passageway during the thermoforming process.

Another object of the invention is to provide a removable plug which facilitates the save immersion and removal of a thermoformable plug from a hot water bath.

Still another object of the invention is to provide a plug for thermoformable dive mouthpiece which may be inserted into the in-mouth portion of the passageway to protect the passageway during storage.

Yet another object of the invention is to provide a shape-maintaining plug that obviates the need for providing a shape-piece of a non-thermoformable material during the mouthpiece manufacturing process.

How these and other objects are accomplished will become apparent from the following descriptions and the drawings.

SUMMARY OF THE INVENTION

The invention involves a plug for a dive mouthpiece of the type that has a passageway extending through it. The passageway has a proximal, in-mouth port and a distal, out-of-mouth port at respective ends of the passageway. The passageway has a passageway shape. The plug comprises a plug portion and a handle portion. The plug portion has a plug-portion distal end and a plug-portion proximal end. The plug-portion also has a plug-portion exterior surface, which is complementary in shape to a distal portion of the passageway shape. The handle portion has a handle-portion proximal end integral with the plug-portion distal end. The handle portion also has a handle-portion exterior surface which is configured to be complementary in shape to the proximal portion of the passageway shape.

In one preferred embodiment, the handle portion has an aperture extending therethrough.

In another preferred embodiment, the plug-portion proximal end has a raised discontinuity. This discontinuity is configured to interact with a furrow discontinuity of the distal portion of the passageway shape.

In yet another preferred embodiment, the mouthpiece is thermoformable at a first temperature and the plug is not thermodeformable at that first temperature.

In still another embodiment, the plug portion has a plug-portion major axis extending from the plug-portion distal end to the plug-portion proximal end. Further, the handle portion has a handle-portion longitudinal axis co-linear with the plug-portion major axis and has a handle-portion lateral axis radial to the plug-portion major axis.

In a further embodiment, the handle portion and plug portion are preferably monolithic.

In another preferred embodiment, the handle-portion distal end has a handle-portion distal edge that is beveled.

In still yet another preferred embodiment, the plug portion has a plug aperture extending laterally through the plug portion. Alternatively and/or coincidentally, it is advantageous for the plug portion to have a plug aperture extending transversely through the plug portion.

It is another aspect of this invention to provide a type of plug for a dive mouthpiece of the type having a passageway therethrough. As with the prior aspect summarized above, the dive mouthpiece has a passageway that extends from a proximal, in-mouth port to a distal, out-of-mouth port. The passageway further has a passageway shape. The plug comprises a plug portion and a handle portion. The plug portion has a plug-portion distal and proximal ends. The plug portion distal end has a plug-portion-distal-end exterior surface, which is complementary in shape to a distal portion of the passageway shape. The plug portion also has a plug-portion major axis extending from the plug-portion distal end to the plug-portion proximal end. The handle portion has a handle-portion proximal end integral with the plug-portion distal end and has a handle-portion longitudinal axis co-linear with the plug-portion major axis. The handle portion also has a handle-portion lateral axis radial (by the term "radial", Applicant means normal or perpendicular) to the plug-portion major axis. By the term "axis", Applicant means a line running through a central portion of an object. Preferably, in most contemplated applications (although the invention is not limited to such contemplated applications), the material making up the objects (or parts of objects) will be homogeneous and the objects (or parts of objects) will be geometrically symmetric, such that the axes will pass through the center of mass of the object (or parts of objects) and there will exist some symmetry about the axis. Moreover, Applicant does not imply with the term "major axis" that the axis described thereby is necessarily through the side of greatest dimension of the object (or parts of objects); rather, the adjective "major" is used to connote the axis that will be co-linear with handle-portion longitudinal axis. Similarly, "longitudinal axis" does not describe an axis necessarily through the side of greatest dimension of the object (or parts of objects), but rather the axis substantially parallel with the longitudinal axis of the passageway when the invention is installed within the passageway.

In certain embodiments, it is preferable for the handle portion to have an aperture extending therethrough.

In other embodiments, it is preferable for the plug-portion proximal end to have a raised discontinuity configured to interact with a furrow discontinuity of the distal portion of the passageway shape. The raised discontinuity could be a ridge.

In other highly preferred embodiments, the mouthpiece is thermoformable at a first temperature, at which temperature, the plug is not thermodeformable. It is more highly preferred in certain of these embodiments for the handle portion and plug portion to be monolithic.

In other embodiments, it is also preferable that the handle portion and plug portion be monolithic.

In other highly preferred embodiments, the handle-portion proximal end has a handle-portion-proximal-end exterior surface configured to be complementary in shape to the proximal portion of the passageway shape. It is more highly preferred in certain of these embodiments that the handle-portion distal end have a handle-portion distal edge which is beveled.

In still yet another preferred embodiment, the plug portion has a plug aperture extending laterally through the plug portion. Alternatively and/or coincidentally, it is advantageous for the plug portion to have a plug aperture extending transversely through the plug portion.

It is still another aspect of this invention to provide a type of plug for a dive mouthpiece of the type having a passageway therethrough. The passageway extends from a proximal, in-mouth port to a distal, out-of-mouth port. The passageway has a passageway shape. The plug comprises a plug portion having a plug-portion proximal end and a plug-portion distal end. The plug-portion has a plug-portion exterior surface, which is complementary in shape to a proximal portion of the passageway shape. The plug also comprises a handle portion having a handle-portion distal end integral with the plug-portion proximal end. Preferably, the handle portion and plug portion are monolithic.

In certain embodiments of this aspect, it is preferable that the handle portion has an aperture extending therethrough.

In certain other embodiments of this aspect of the invention, it is preferable that the plug-portion distal end have a raised discontinuity configured to interact with a furrow discontinuity of the proximal portion of the passageway shape. The raised discontinuity may be a ridge.

In other highly preferred embodiments of this aspect of the invention, the mouthpiece is thermoformable at a first temperature, at which temperature, the plug is not thermodeformable. It is more highly preferred in certain of these embodiments for the handle portion and plug portion to be monolithic.

In certain preferred versions of this aspect of the invention, it is preferable for the handle-portion proximal end to have a handle-portion proximal edge that is beveled.

In other preferred versions of this aspect of the invention, it is preferable for the handle portion to have a handle-portion exterior surface configured to be complementary to the distal portion of the passageway shape.

In still yet another preferred embodiment, the plug portion has a plug aperture extending laterally through the plug portion. Alternatively and/or coincidentally, it is advantageous for the plug portion to have a plug aperture extending transversely through the plug portion.

It is another aspect of this invention to provide a method for storing a dive mouthpiece. The mouthpieces are of the type that have a passageway extending through it. The mouthpiece passageway has a distal regulator end and a proximal in-mouth end. The invention comprises the steps of urging the distal regulator portion into engagement with the regulator, and inserting a dive-mouthpiece plug into the proximal in-mouth end of the passageway. The dive-mouthpiece plug has a plug portion.

It is still another aspect of the invention to provide a method for thermoforming a scuba-diving mouthpiece of the type having a front portion with a breathing hole and custom-moldable rear portions engageable by a diver's teeth comprising the steps of: (1) providing a preformed thermoformable custom-moldable scuba-diving mouthpiece base member; (2) inserting a plug; (3) applying heat to the assembly to increase the temperature of the assembly to at least the first temperature; (4) placing the assembly in the mouth of the diver with bite portions positioned between the diver's teeth; (5) causing the diver to bite on the bite portions to mold said bite portions; (6) removing the assembly from the diver's mouth; and (7) allowing the assembly to cool to a temperature less than the first temperature. The preformed thermoformable custom-moldable scuba-diving mouthpiece base member includes the front portion and a pair of bite portions extending rearwardly therefrom for positioning between the diver's teeth. The preformed thermoformable custom-moldable scuba-diving mouthpiece base member is thermoformable at a first temperature. The plug is of a plug shape complementary to a breathing-hole shape of the breathing hole. The plug is not thermoformable at the first temperature.

DETAILED DESCRIPTION OF PREFERRED EMBODIMENTS

As seen in FIGS. 1-5, plug 10 has a proximal portion 12 and a distal portion 14. For orientation purposes in this description, the directional terms "proximal" and "distal" will be discussed with regard to a dive mouthpiece properly inserted in the mouth for use. The directional term "proximal" will generally refer to an inward direction with respect to the mouth and the term "distal" will generally refer to an outward direction with respect to the mouth. The same directional convention shall apply herein to components (e.g., distal and proximal portions) as the components are installed in the mouthpiece.

Figure 1:
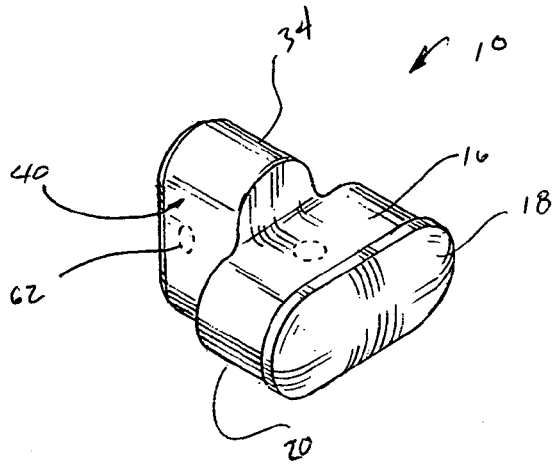
FIG. 1 is a perspective view of a plug.
Figure 2:
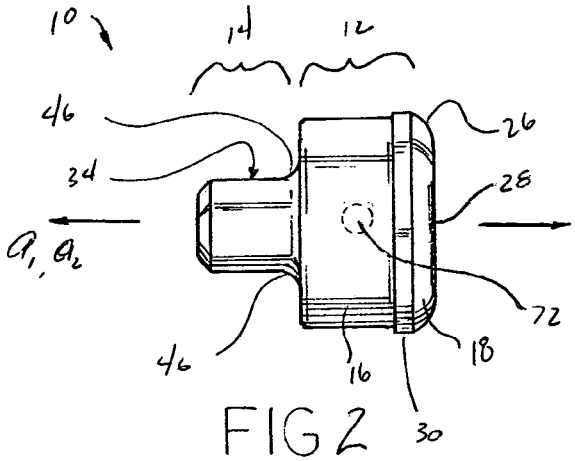
FIG. 2 is a top view of view of the plug of FIG. 1.
Figure 5:
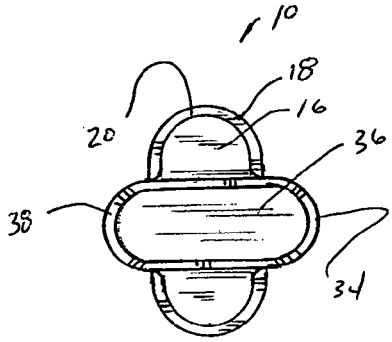
FIG. 5 is a rear view of view of the plug of FIG. 1.

Proximal portion 12 comprises a head 16 and a cap 18. As best seen in FIGS. 1 and 5, head 16 has an ovoid shaped cross-section that is generally uniform along its entire head portion outer surface 20. This head portion 16 of the uniform ovoid shaped cross-section is exactly complementary in shape to a regulator portion 22 of passageway 24 (best seen in FIGS. 6 and 8; for the general shape of the regulator portion of a passageway, see also FIG. 3 of U.S. Pat. No. D0,395,083 issued to Forman).

Cap 18 has a convex, bullet-like outer surface 26 which smoothly transitions from the proximal-most edge 28 to rim skirt 30.

Figure 6:
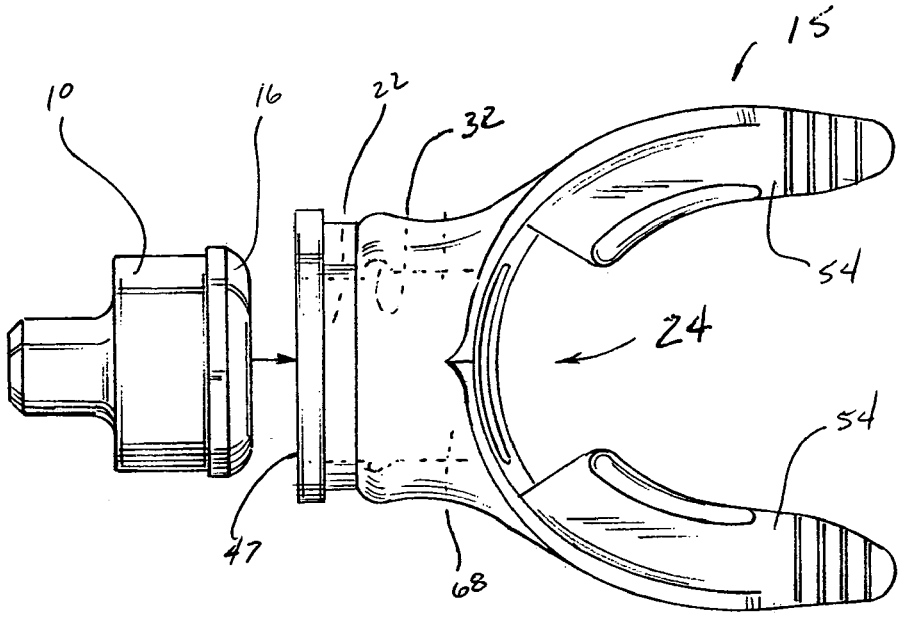
FIG. 6 is a top view of the plug and of a mouthpiece.
Figure 8:
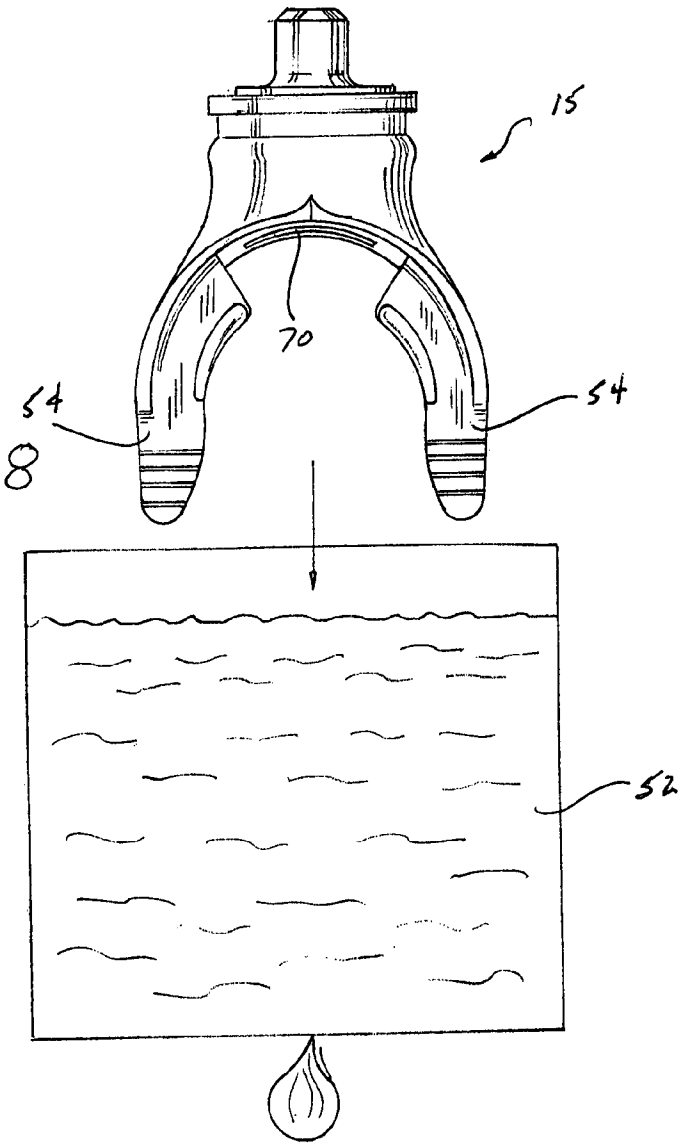
FIG. 8 is a side view of a heated water bath about to receive a mouthpiece.

As better seen in FIGS. 6 and 8, rim skirt 30 has an ovoid cross section, which is shaped and dimensioned to be complementary with engagement groove 32 of passageway 24.

Figure 4:
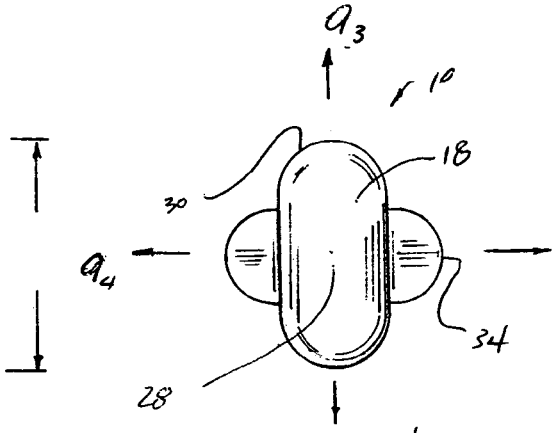
FIG. 4 is a front view of view of the plug of FIG. 1.

As best seen in FIGS. 1, 4, and 5, proximal end 40 of distal portion 14 has an ovoid shaped cross-section that is generally uniform along its entire distal portion outer surface 34.

Distal portion 14 also has a distal end 42 with planar distal face 36 which is perpendicular to distal portion outer surface 34. Transitioning between distal portion outer surface 34 and distal face 36 is beveled edge 38.

Distal portion 14 and proximal portion 12 are preferably monolithic. To provide strength, it is preferable that distal portion 14 and proximal portion 12 be of solid material with uniform density throughout. In these ways, when being removed from the dive mouthpiece as described further herein, pressure can be applied to either portion 12, 14 without concern of damage to plug 10.

Plug 10 has a plug longitudinal axis $A_1$. Plug longitudinal axis $A_1$ is coaxial with proximal portion longitudinal axis $A_2$. Ovoid cap 18 has a geometric cap semi-major axis $A_3$, which is perpendicular to plug longitudinal axis $A_1$. In a like manner, ovoid distal portion 14 has a geometric distal-portion semi-major axis $A_4$, which is perpendicular to plug longitudinal axis $A_1$.

Figure 7:
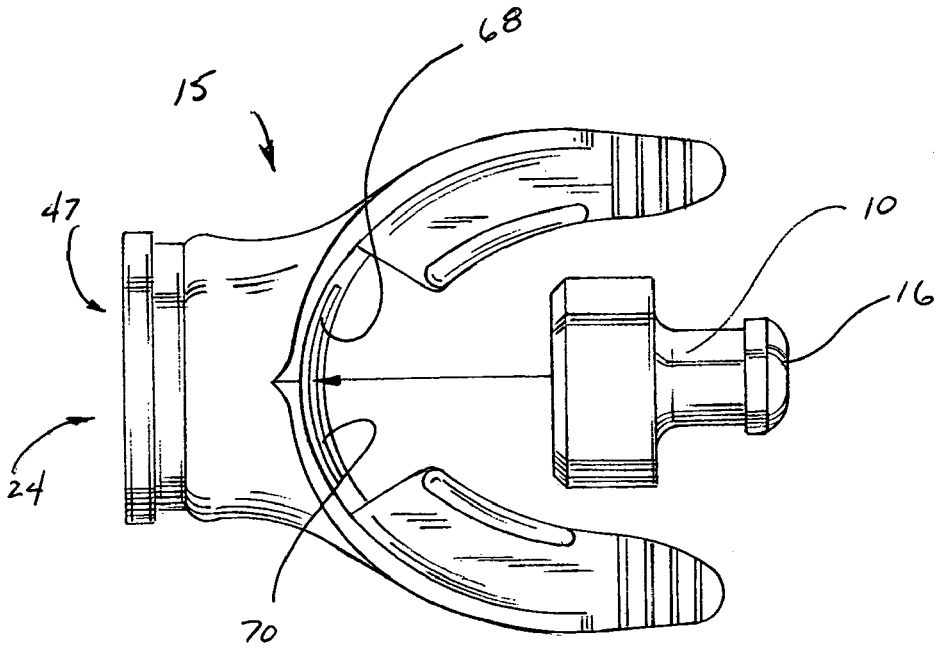
FIG. 7 is a side view of the plug and a top view of a mouthpiece.
Figure 10:
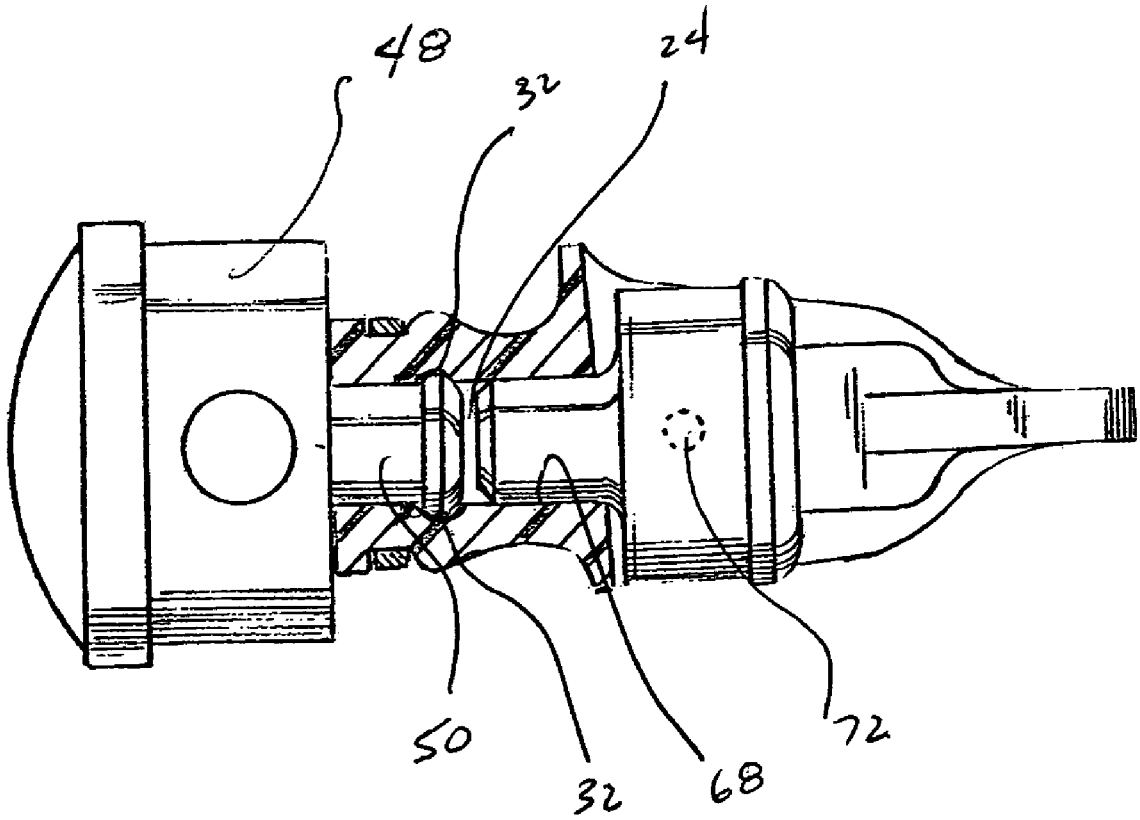
FIG. 10 is a side sectional view of a mouthpiece containing a regulator and a plug.

Moreover, it is preferable in certain embodiments such as that illustrated in FIGS. 1-5, but not necessary, that distal portion 14 and proximal portion 12 be oriented perpendicular to each other (i.e., that cap semi-major axis $A_3$ is perpendicular to distal-portion semi-major axis $A_4$). In this orientation, when a removing force is applied normal to distal portion outer surface 34 of distal-portion proximal end 40 (i.e., parallel to cap semi-major axis $A_3$), longitudinal torque is induced along plug 10 to pull proximal portion 12 out of engagement with regulator portion 22 of passageway 24. Moreover, when inserted into the in-mouth portion 68 (as seen in FIGS. 7 and 10), maximum clearance is obtained between head portion outer surface 20 and tooth-engaging legs 54. It will be recognized, of course, that such perpendicular orientation between proximal portion 12 and distal portion 14 has specific advantages, and that a generally coplanar orientation (with cap and distal-portion semi-major axes $A_3$, $A_4$ coplanar) would provide alternative advantages (e.g., with respect to storage and packaging of such a coplanar plug).

The transition between distal portion outer surface 34 and proximal portion outer surface 20 are hyperbolic necks 44 and throats 46. A gradual transition between distal portion outer surface 34 and proximal portion outer surface 20 through means such as hyperbolic neck and throats 44, 46 facilitate cleaning. Moreover, such non-severe transition extends the life of plug 10 which in use will be subjected to regular pressure application perpendicular to faces 28,36.

Plug 10 must be made of a suitable material. Considerations for pug material include stress/strain resistivity, thermal non-expandability during the mouthpiece thermoforming process, thermo-nondeformability during the mouthpiece thermoforming process, and commercial manufacturibility. Thermo-nondeformability-suitability is determined in part by the material chosen for the mouthpiece.

It is necessary in producing thermoforming mouthpieces that the mouthpiece material must satisfy at least three criteria: (1) the material must remain pliable at a forming temperature, which is above the ambient mouth temperature and such that the mouthpiece at that forming temperature will not cause tissue damage when the mouthpiece is placed in the mouth during the thermoforming process, (2) that material must be non-formable at an ambient temperature range typically found in human mouths, and (3) the material must be nontoxic. Suitable mouthpiece materials previously have been found (e.g., in U.S. Pat. Nos. 5,031,611 and 5,865,170 issued to Moles) to include ethylene vinyl acetate and ethylene vinyl acetate blends which are softenable, and thus custom moldable in the diver's mouth. Certain FDA-approved polyvinyl chloride materials may be used instead. Preferred mouthpiece materials have in-mouth molding temperatures well under 120° F.

Conversely, it is imperative that plug material not be thermoformable at the in-mouth molding temperatures (of approximately 120° F., depending on the material chosen). Further, it is more preferable that the plug material not be thermoformable below 212° F. (as a boiling water bath is frequently used in the mouthpiece thermo-forming process). Examples of suitable materials for plug 10 are: various blends of styrenic TPE (thermoplastic elastomer) and ethylene vinyl acetate; various blends of styrenic TPE and polypropylene; and semi-rigid PVC. Of course, it is important that the material of the plug not create a toxic leachate at any temperature range within which plug 10 will be subjected during the mouthpiece thermo-forming process or during the storage use of plug 10.

A preferred blend of styrenic TPE and ethylene vinyl acetate would include 95% of KRATON, a styrenic TPE from Shell Chemical, Houston, Tex., and 5% of ELVAX 550, an ethylene vinyl acetate from DuPont, Wilmington, Del. Adjusting the relative amounts of KRATON and ELVAX 550 tends to adjust the hardness of plug 10. A preferred blend of styrenic TPE and polypropylene has 88% of KRATON and 12% of polypropylene FDA blend.

Figure 9:
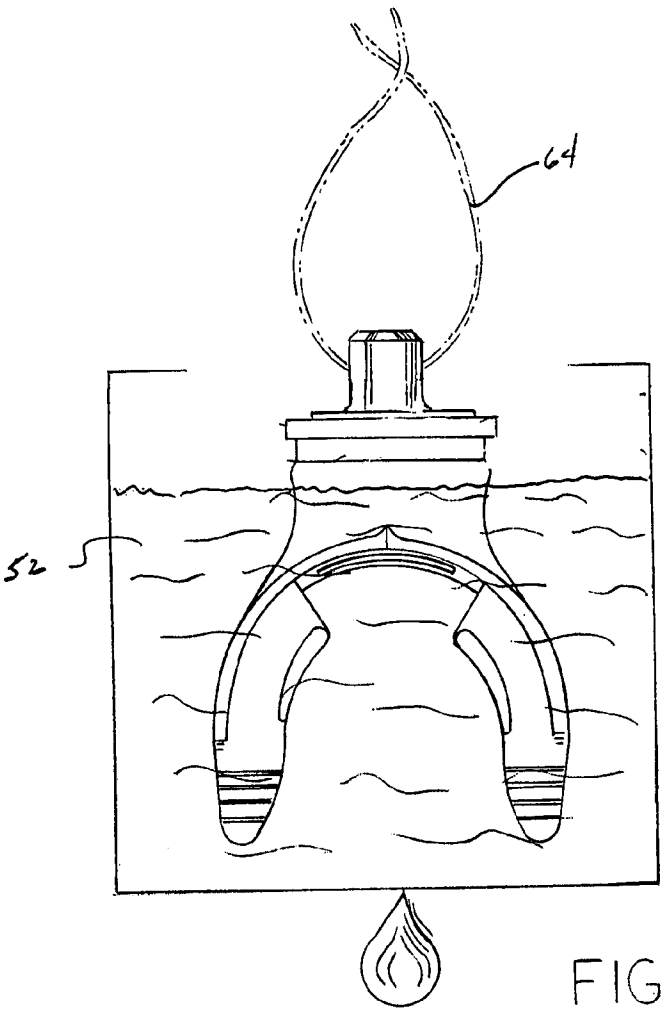
FIG. 9 is a side view of a heated water bath containing a mouthpiece.

As seen in FIGS. 6, 8, and 9, in mouthpiece thermo-forming operation, proximal portion 12 is inserted through distal end 47 of passageway 24 into regulator portion 22. In the process, movement of cap 18 (which has a cross-sectional area greater than cross-sectional area of regulator portion 22 of passageway 24) within passageway 24, is facilitated by bullet-like outer surface 26.

Dive mouthpieces such as thermoformable dive mouthpiece 15, are designed for use with regulators 48. Regulators 48 each have a standard proximal nozzle 50. Therefore, thermoformable dive mouthpiece 15 has regulator portion 22 of passageway 24 configured in shape and dimension to accommodate precisely proximal nozzle 50 (as seen in FIG. 10) to maintain a water-tight connection between thermoformable mouthpiece 15 and proximal nozzle 50 when in dive use. Moreover, to facilitate the water-tight connection, thermoformable mouthpiece 15 has elastic properties at normal-use temperatures designed to resiliently flex and seal about proximal nozzle 50.

The preferred embodiment of the invention illustrated in FIG. 10 makes use of the interaction between proximal nozzle 50 and regulator portion 22. Proximal portion 12 with its head and cap components 16, 18, are designed to be dimensionally similar to regulator proximal nozzle 50. Proximal portion 12 of plug 10 is inserted into regulator portion 22 of passageway 24 until such point as rim skirt 30 enters into engagement with engagement groove 32. At this point, due to the complimentary nature of proximal portion outer surface 20 and regulator portion 22 of passageway 24, the combination is watertight not allowing any fluid into passageway 24 through the distal opening of passageway 24.

A boiling water bath is prepared as shown in FIG. 8. Using distal portion 14 as a handle, dive mouthpiece 15 is immersed into waterbath 52 such that thermoformable, tooth-engaging legs 54 are immersed in the waterbath 52 (as seen in FIG. 9). As taught in U.S. Pat. No. 5,305,741 issued to Moles, dive mouthpiece 15 is dipped in boiling water for about ten seconds to prepare it for customizing. Continuing to use distal portion 14 as a handle, mouthpiece 15 is removed from the water and then quickly placed into the mouth of the diver so that tooth-engaging legs 54 may be molded by the diver's bite. The surface temperature during such bite may be on the order of 120° F. or less, preferably about 110° F. Throughout the heating and biting process, proximal portion outer surface 20 maintains the shape of regulator portion 22 of passageway 24, even if passageway 24 has been subjected to thermodeforming temperatures while dive mouthpiece 15 is in water bath 52.

After bite molding of tooth-engaging legs 54, using distal end 14 as a handle, dive mouthpiece is removed from the mouth and allowed to cool. After cooling, plug 10 may be removed from passageway 24.

Figure 3:
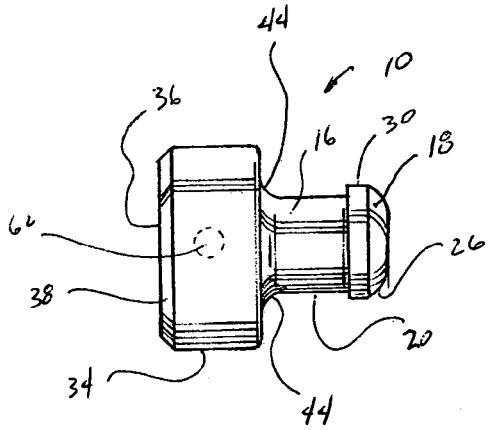
FIG. 3 is a side view of view of the plug of FIG. 1.

In certain embodiments, it is preferable to provide a chain passage 62 through distal portion 14 (seen in FIGS. 3 and 9). Chain 64 is then inserted through chain passage 62. In this way, dive mouthpiece 15 may be lowered into waterbath 52 by means of chain 64 such that the hands holding chain 64 may be kept out of proximity of hot waterbath 52. Moreover, during the cooling step after molding, chain 64 may be utilized to suspend the dive mouthpiece/plug 15,10 combination in air in a manner such that tooth-engaging legs 54 do not encounter any material object while cooling from the thermoforming temperature.

As seen in FIG. 10, plug 10 is also useful during storage of dive mouthpiece 15. Prior to this invention, dive mouthpieces 21 were typically stored attached to regulator proximal nozzle 50. When stored in this pre-invention manner, proximal part 68 of passageway 24 is open allowing dust, debris, insects, and microscopic biota to enter passageway 24. As described above, distal portion 14 has an ovoid shaped cross-section that is generally uniform along its entire distal portion outer surface 34. The ovoid shaped cross-section of distal portion 14 is complementary to the inner surface 66 of the proximal part 68 of passageway 24. Beveled edge 38 is provided to facilitate insertion of distal end 14 of plug 10 into proximal part 68 of passageway 24. Through insertion of distal end 14 of plug 10 of this invention into proximal part 68 of passageway 24 through proximal end 70, passageway 24 is sealed at both ends (distal part of passageway 24 being sealed by regulator 48).

A chain channel 72 is supplied on proximal portion 12 to allow for chain 64 (seen in FIG. 9 through chain passage 62) to be threaded through.

While the principles of the invention have been shown and described in connection with specific embodiments, it is to be understood that such embodiments are by way of example and are not limiting.

The invention claimed is:

1. A plug for a dive mouthpiece, the mouthpiece having a passageway therethrough extending from a proximal, in-mouth port to a distal, out-of-mouth port, the passageway having a passageway shape, the plug comprising:

a plug portion having a plug-portion distal end, a plug-portion proximal end, and a plug-portion exterior surface configured to be complementary in shape to a distal portion of the passageway shape, whereby the plug portion seals off the distal portion of the passageway when inserted therein; and a handle portion having a handle-portion proximal end integral with the plug-portion distal end, a handle-portion distal end, and a handle-portion exterior surface configured to be complementary in shape to a proximal portion of the passageway shape, whereby the handle portion seals off the proximal portion of the passageway when inserted therein.

2. The plug of claim 1 wherein the handle portion has an aperture extending therethrough.

3. The plug of claim 1 wherein the plug-portion proximal end has a raised discontinuity configured to interact with a furrow discontinuity of the distal portion of the passageway shape.

4. The plug of claim 1 wherein the mouthpiece is thermoformable at a first temperature and wherein the plug is not thermodeformable at the first temperature.

5. The plug of claim 1 wherein the plug portion has a plug-portion major axis extending from the plug-portion distal end to the plug-portion proximal end, and wherein the handle portion has a handle-portion longitudinal axis colinear with the plug-portion major axis and has a handle-portion lateral axis radial to the plug-portion major axis.

6. The plug of claim 1 wherein the handle portion and plug portion are monolithic.

7. The plug of claim 1 wherein the handle-portion distal end has a beveled handle-portion distal edge.

8. The plug of claim 1 wherein the plug portion defines a lateral plug aperture extending laterally through the plug portion.

9. The plug of claim 1 wherein the plug portion defines a transverse plug aperture extending transversely through the plug portion.

10. A plug for a dive mouthpiece of the type having a passageway therethrough extending from a proximal, in-mouth port to a distal, out-of-mouth port, the passageway having a passageway shape, the plug comprising:

a plug portion having a plug-portion proximal end and a plug-portion distal end with a plug-portion-distal-end exterior surface configured to be complementary in shape to a distal portion of the passageway shape, a plug-portion major axis extending from the plug-portion distal end to the plug-portion proximal end; and a handle portion having a handle-portion proximal end integral with the plug-portion distal end, a handle-portion longitudinal axis co-linear with the plug-portion major axis, and a handle-portion lateral axis radial to the plug-portion major axis.

11. The plug of claim 10 wherein the handle portion has an aperture extending therethrough.

12. The plug of claim 10 wherein the plug-portion proximal end has a raised discontinuity configured to interact with a furrow discontinuity of the distal portion of the passageway shape.

13. The plug of claim 10 wherein the mouthpiece is thermoformable at a first temperature and wherein the plug is not thermodeformable at the first temperature.

14. The plug of claim 13 wherein the handle portion and plug portion are monolithic.

15. The plug of claim 10 wherein the handle portion and plug portion are monolithic.

16. The plug of claim 10 wherein the handle-portion proximal end has a handle-portion-proximal-end exterior surface configured to be complementary in shape to a proximal portion of the passageway shape.

17. The plug of claim 16 wherein the handle portion includes a handle-portion distal end having a beveled handle-portion distal edge.

18. The plug of claim 16 wherein the plug portion defines a lateral plug aperture extending laterally through the plug portion.

19. The plug of claim 16 wherein the plug portion defines a transverse plug aperture extending transversely through the plug portion.

20. A plug for a dive mouthpiece, the mouthpiece having a passageway therethrough extending from a proximal, in-mouth port to a distal, out-of mouth port, the passageway having a passageway shape, the plug comprising:

a plug portion having a plug-portion proximal end, a plug-portion distal end, a plug-portion exterior surface configured to be complementary in shape to a proximal portion of the passageway shape, and a plug-portion major axis extending from the plug-portion distal end to the plug-portion proximal end; and a handle portion having a handle-portion distal end integral with the plug-portion proximal end, a handle-portion longitudinal axis co-linear with the plug-portion major axis, and a handle-portion lateral axis radial to the plug-portion major axis.

21. The plug of claim 20 wherein the handle portion has an aperture extending therethrough.

22. The plug of claim 20 wherein the plug-portion distal end has a raised discontinuity configured to interact with a furrow discontinuity of the proximal portion of the passageway shape.

23. The plug of claim 20 wherein the mouthpiece is thermoformable at a first temperature and wherein the plug is not thermodeformable at the first temperature.

24. The plug of claim 23 wherein the handle portion and plug portion are monolithic.

25. The plug of claim 20 wherein the handle portion and plug portion are monolithic.

26. The plug of claim 20 wherein the handle portion includes a handle-portion proximal end having a beveled handle-portion proximal edge.

27. The plug of claim 20 wherein the handle portion has a handle-portion exterior surface configured to be complementary in shape to a distal portion of the passageway shape.

28. The plug of claim 27 wherein the plug portion defines a lateral plug aperture extending laterally through the plug portion.

29. The plug of claim 27 wherein the plug portion defines a transverse plug aperture extending transversely through the plug portion.

* * * * *